United States Patent [19]

Massey et al.

[11] Patent Number: 4,814,021

[45] Date of Patent: Mar. 21, 1989

[54] APPARATUS AND METHOD FOR RECLASSIFYING ELECTRICAL APPARATUS CONTAMINATED WITH PCB

[75] Inventors: Michael J. Massey, Newton; David R. Hopper, Randolph, both of Mass.

[73] Assignee: ENSR Corporation, Houston, Tex.

[21] Appl. No.: 78,480

[22] Filed: Jul. 27, 1987

Related U.S. Application Data

[63] Continuation-in-part of Ser. No. 891,612, Aug. 1, 1986, abandoned.

[51] Int. Cl.[4] ..... B08B 3/10

[52] U.S. Cl. ..... 134/12; 134/22.14; 134/22.19; 134/26; 159/DIG. 8; 202/169; 202/170; 203/75; 203/78; 203/82; 203/84

[58] Field of Search ..... 134/12, 26, 22.14, 22.19; 203/75, 78, 82, 84; 202/170, 174, 169; 159/DIG. 8

[56] References Cited

U.S. PATENT DOCUMENTS

| | | | |
|---|---|---|---|
| 2,555,939 | 6/1951 | Sherwin | 203/78 |
| 3,483,092 | 12/1969 | Young | 203/1 |
| 3,700,566 | 10/1972 | Bellinger et al. | 203/1 |
| 3,705,203 | 12/1972 | Smith | 260/674 |
| 3,839,087 | 10/1974 | Beckers | 134/31 |
| 4,055,507 | 10/1977 | Dactur et al. | 134/40 |
| 4,072,596 | 2/1978 | Moeglich | 204/241 |
| 4,127,598 | 11/1978 | McEntee | 260/448 |
| 4,236,973 | 12/1980 | Robbins | 203/10 |
| 4,284,516 | 8/1981 | Parker et al. | 210/757 |
| 4,293,433 | 10/1981 | Borror et al. | 252/63.7 |
| 4,299,704 | 11/1981 | Foss | 210/634 |
| 4,304,612 | 12/1981 | Masuda | 134/19 |
| 4,312,794 | 1/1982 | Pearce et al. | 252/581 |
| 4,337,368 | 6/1982 | Pytlewski et al. | 568/730 |
| 4,340,471 | 7/1982 | Jordan | 210/101 |
| 4,353,798 | 10/1982 | Foss | 210/181 |
| 4,387,018 | 6/1983 | Cook et al. | 208/262 |
| 4,425,949 | 1/1984 | Rowe, Jr. | 427/116 |
| 4,436,902 | 3/1984 | Wood et al. | 528/501 |
| 4,483,717 | 11/1984 | Olmsted et al. | 134/12 |
| 4,512,782 | 4/1985 | Bauer et al. | 252/581 |
| 4,526,677 | 7/1985 | Grantham et al. | 208/262 |
| 4,549,034 | 10/1985 | Sato et al. | 17/17 LF |
| 4,595,509 | 6/1986 | Fox et al. | 210/665 |
| 4,659,443 | 4/1987 | Byker | 204/131 |
| 4,685,972 | 8/1987 | Fowler | 134/12 |
| 4,690,698 | 9/1987 | Reid | 55/89 |
| 4,738,780 | 4/1988 | Atwood | 210/634 |
| 4,744,905 | 5/1988 | Atwood | 210/634 |

FOREIGN PATENT DOCUMENTS

| | | | |
|---|---|---|---|
| 0080808 | 6/1983 | European Pat. Off. | 134/12 |
| 0188698 | 7/1986 | European Pat. Off. | 134/12 |

OTHER PUBLICATIONS

J. H. Olmsted, "Transformer Askarel Removal to an EPA Clean Level", Proceedings IEEE, 1A 579:34C, pp. 1053–1055.

*Primary Examiner*—Asok Pal

*Attorney, Agent, or Firm*—John R. Kirk, Jr.; Kurt S. Myers

[57] ABSTRACT

A method for cleaning and reclassifying electrical apparatus designed for use with PCB fluid electrolytes is described which is capable of operation on the site of the equipment being cleaned and while said equipment is energized.

7 Claims, 3 Drawing Sheets

APPARATUS AND METHOD FOR RECLASSIFYING ELECTRICAL APPARATUS CONTAMINATED WITH PCB

RELATED APPLICATIONS

This is a continuation-in-part of U.S. patent application Ser. No. 891,612, filed Aug. 1, 1986, entitled "Method of Reclassifying Electrical Apparatus Contaminated with PCB," now abandoned.

BACKGROUND OF THE INVENTION

The subject invention relates to electrical apparatus, such as transformers and capacitors, designed to use as a liquid dielectric fluid polychlorinated byphenyls, and a porous internal construction. Such apparatus is characterized by the adsorption of the liquid into the pores of structural support media, thereby rendering difficult the complete removal of said liquid.

For many years polychlorinated biphenyls (PCB or PCB's) have been used as an insulation or dielectric fluid in the electrical apparatus industry as a safe, fire resistant material. Dielectric fluids containing such PCB's have often been generically called askarels where the PCB is often present as a mixture in a chlorinated benzene solvent. In the late 60's and early 70's it was discovered that PCB's were hazardous environmental contaminants and their use was discontinued; however, by that time many pieces of electrical apparatus had been built using the PCB's as an insulation media. A primary use of PCB is in electrical transformers and electrical capacitors as a coolant dielectric fluid. This invention relates to cleaning PCB's from such apparatus and eventual reclassification of it as non-PCB equipment. For reclassification it is presently necessary that tests demonstrate a contamination of less than 50 ppm of PCB in the dielectric fluid after three months of operation succeeding the completion of cleaning.

Transformers designed for PCB use all have a major similarity in that they contain a cellulosic material as insulation, usually a paper wrap, on the wire comprising the core of the transformer. Included in the transformer may be wooden structures acting as insulators. Because of these two major items, the interior of the transformer acts somewhat like a sponge and PCB's become impregnated into these materials. They are contained in such a manner that simple washing will not remove them, and that, over a period of time, the PCB's will leach out of the cellulosic material and come to an equilibrium level in the transformer even if it had been filled with clean, non-PCB, oil. Transformers which use a mineral oil dielectric are different and the invention does not apply.

A similar problem is encountered in the disposal of transformers and capacitors which are impregnated with more than 500 ppm PCB or PCB contaminated liquids which are understood to be liquids containing from 50 to 500 ppm PCB. Regulations imposed by the United States Environmental Protection Agency prohibit the recovery and recycling of the equipment unless the equipment can be certified as non-PCB equipment under those regulations.

Several methods are used or have been proposed for the cleanup, or reclassification, of transformers. Complete flushings have been proposed with several classes of fluids thereby generating large volumes of PCB contaminated, or PCB, material by the United States Environmental Protection Agency (EPA) definitions. These methods involve vacuum extraction and condensation of vaporized solvents but have been found lacking for a number of reasons.

The major problem with prior methods is that they either generate a very large volume of contaminated fluid, with more than 500 ppm of PCB, and require long periods of time to successfully complete cleaning or they include complicated process steps during which the equipment must be kept out of service or service is frequently interrupted. Several discussions of the problem of cleaning PCB and PCB contaminated electrical apparatus, particularly transformers, are found in U.S. Pat. Nos. 4,483,717, 4,425,949 and 4,312,794 and a literature reference ("Transformer Askarel Removal to an EPA Clean Level," J. H. Olmstead. Proceedings IEEE, 1 AS 79:34, See pages 1053 through 1055), which describe the cycling of transformer dielectric fluid through a filtration system to scavenge PCB.

Other methods suffer from high labor requirements, the necessity of hauling of contaminated fluids to separation equipment, often over public roads to offsite locations, or employ complicated separation techniques. Up to now simple, onsite and unattended apparatus and methods for cleaning, or reclassifying, transformers designed for PCB dielectric fluid while maintaining the transformer on line and energized, or under a power load, having been wanting. With this invention such problems have been solved.

Also provided as a part of the present invention is a cleaning system (apparatus) for use in the practice of the present method.

SUMMARY OF THE INVENTION

The present invention relates to apparatus and methods for cleaning and reclassifying liquid filled electric apparatus designed to use PCB dielectric fluid to meet at least the present EPA standards as "non-PCB" equipment. Apparatus designed to use mineral oils are not cleaned hereby. This invention allows such cleaning while the electric apparatus designed for PCB use particularly a transformer, is energized and operating on line. Normally only a single discontinuance of service of the electric apparatus is necessary, and occurs to initially drain a PCB, or PCB contaminated, fluid from the electric apparatus. Maintenance can then be performed. During this time the apparatus can be modified if necessary and connected to the cleaning apparatus, which includes a distillation unit. The apparatus is filled with a leaching fluid chosen both to leach PCB's from the core, or cellulosic material insulation on the core wiring of a transformer, and to serve as the insulating dielectric fluid coolant for maintaining the electric apparatus on line and energized while the method of reclassification is being performed. Leaching fluid is circulated from the electric apparatus through the distillation unit, where it is separated from PCB's being removed from the electrical apparatus, and recirculated back through the transformer. The concentrated PCB's are accumulated on site for disposal. These steps are repeated until the electrical apparatus is capable of reclassification, at which time the transformer is either reclassified with the leaching fluid left in the transformer or the leaching fluid is removed from the transformer and replaced with an alternative permanent dielectric fluid, such as mineral oil, silicones, mixtures thereof or the like and then the reclassification test, ninety (90) days of operation is performed. The leaching fluid can be replaced while continuing in service, however it is preferable that this substitution of fluids be performed during a brief interruption of operation of the electric apparatus.

DETAILED DESCRIPTION OF THE PREFERRED EMBODIMENTS

Figure 1:
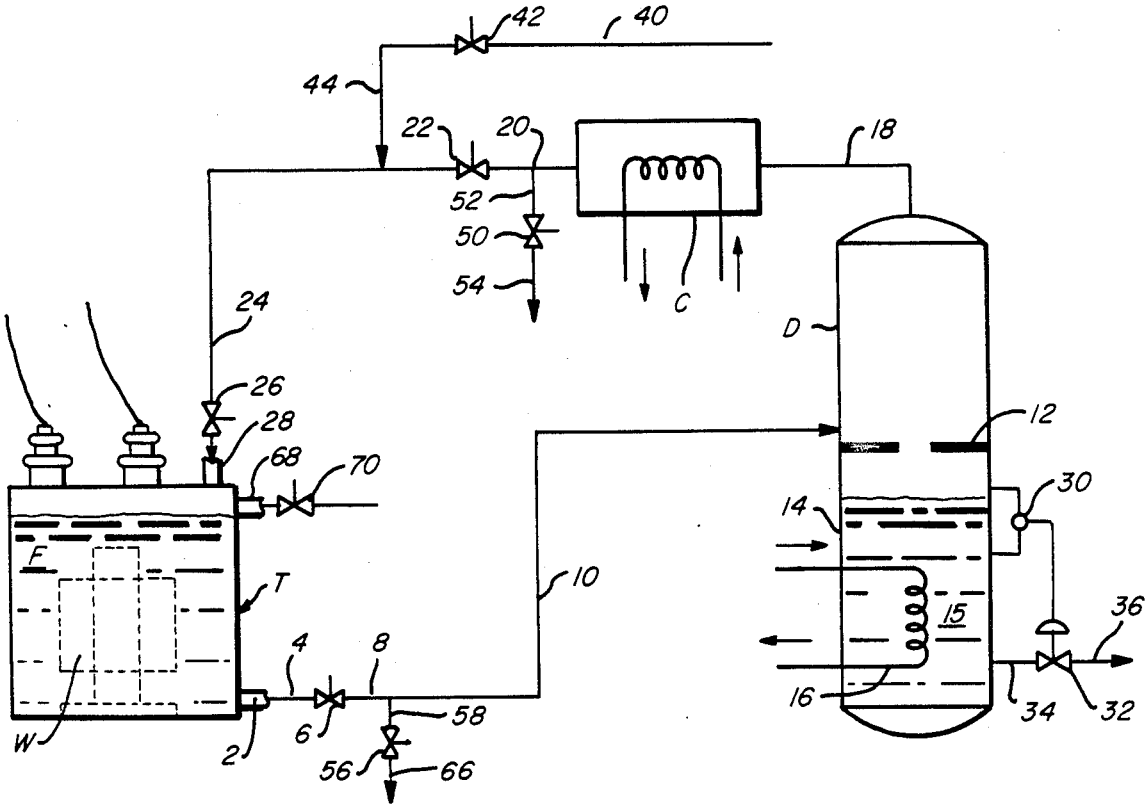
FIG. 1 is a schematic flow sheet showing the method of this invention as applied to reclassifying a PCB, or PCB-contaminated, transformer.

The method of the present invention can be understood by its application to one preferred embodiment; i.e., the draining, decontamination and reclassifying of electrical power transformers which have been previously insulated with a PCB coolant fluid. It will be understood that other liquid materials including chlorinated benzene which are often found accompanying PCB's in electrical apparatus like power transformers may be removed by the process of this invention along with the PCB's.

The primary advantage of the method of the present invention comes from the onsite, unattended reclassification of electrical apparatus in a manner which is capable of being conducted without substantial periods of interruption of operations of such equipment. This method can be practiced either continuously or in a periodic, batch mode as described herein where operation is not continuous but is positioned in a batch mode and carried out in such a manner that operation of the apparatus could proceed without interruption. In the batch mode the equipment useful in the practice of this invention may also be placed near the electrical apparatus the contaminated fluid may be transported to the equipment.

In accordance with the methods and processes of this invention, the equipment, here a transformer, is first drained to remove the bulk of the PCB's therefrom. The transformer is then preferably washed with an amount of solvent, or leaching fluid, of from about one to about ten percent of its volume to remove any major gross puddles of PCB's. The liquid solvent, or leaching fluid, is dispersed throughout the case to flush out radiators and other parts of the transformer. This solvent is then either removed from the transformer and stored for further processing at the site or run through the distillation unit as hereinafter described in the practice of the invention to separate it from the PCB's. Maintenance would be preferably performed on the apparatus to change gaskets and the like during this period.

At this point the electrical apparatus, here a transformer, has been processed in the manner which is normal to the industry in preparation for refilling with a non-PCB liquid. Bulk liquid has been drained, and significant pools have been removed so that the residual PCB's available for contaminating the new fluid amounts to small amounts relative to the total liquid capacity of the transformer. However, significant amounts of PCB's remain absorbed in the core of the transformer, available to leach out once the transformer is refilled with dielectric fluid and placed back on-line.

During this initial drain, rinse time and maintenance, the transformer may be conveniently fitted with means for removing the fluid, connections and valves and the like, to provide for conducting leaching fluid in and out of the transformer without interrupting on-line, energized cleaning and reclassification in accordance with this invention. The added valves allow the possibility of refilling of the transformer with a dielectric fluid different from the leaching fluid with a minimum of interruption, if any, of the operation of the transformer. A distillation unit as described herein is attached to fittings, hereinafter described, on the transformer which, for purposes of this discussion, is filled with a liquid leaching fluid. The liquid leaching fluid may be any fluid which is a solvent for the PCB and which has a boiling point sufficiently distant from that of the PCB to be easily separated by distillation; i.e., having a boiling point sufficiently below that of the PCB to form a sharp separation.

The PCB compounds normally used for electrical apparatus, particularly transformers, are usually a wide range of cogeners which boil within the range of about 250° to about 500° C. Commonly used PCB containing fluids were called askarels which were often mixtures of biphenyls having differing degrees of chlorination in a trichlorobenzene (TCB) solvent; for example, common mixtures contained from about 50% to about 85% mixed PCB's and corresponding from about 15% to about 50% TCB.

Preferably the leaching fluid will also have a boiling point sufficiently high to avoid special equipment requirements for condensation of vapors that are generated. The leaching fluid should have the essential properties of a coolant dielectric fluid and be compatible with the internal core of the transformer such that energized operation of the transformer is possible during the steps of the cleaning and reclassification process. In addition to keeping the core submerged during operation, it is important, as is well known to those skilled in the art, to avoid exposure of the core to oxygen and moisture. During operation this is assured by including a siphon leg equipped with a siphon breaking means which controls flow from the transformer to the distillation apparatus which will stop flow of leaching fluid and cause the distillation to stop in the event of danger of the core becoming exposed.

A preferred leaching fluid for use in the practice of this invention is perchloroethylene, boiling point about 121° C., either the pure substance having less than about 100 ppm halohydrocarbon contaminants as described in U.S. Pat. No. 4,312,794 or an inhibited perchloroethylene as described in U.S. Pat. No. 4,293,433, both of which are incorporated herein by reference for all purposes for the disclosure therein made. Another preferred leaching liquid would be an inhibitor stabilized perchloroethylene containing from 200 ppm to about 500 ppm of trichloroethylene. Any of the leaching fluid containing perchloroethylene as described above may be used alone or in conjunction with a hydrocarbon diluent, preferably from about 1% to about 30% by weight thereof, preferably boiling within about 10° C. of the perchloroethylene in order to provide an easy separation by distillation from the PCB's. The hydrocarbon diluent preferably would be selected to preserve the non-flammable nature of the perchloroethylene fluid.

A distillation system can be attached on site as hereinafter described, to the transfromer and operated either continuously or periodically, circulating the leaching fluid from the transformer through the distillation unit where PCB's are removed from the fluid and cleaned leaching fluid is circulated back to the transformer.

Turning now to FIG. 1 for a more specific description of an embodiment of the subject invention, a transformer T lhaving core windings W is filled with leaching fluid F which is withdrawn, preferably by gravity, though it may be pumped, from transformer T through nozzle 2, line 4, valve 6 and line 8 to line 10 and discharged into a distillation column D onto, for purposes of illustration, a tray 12. Though shown otherwise, flow to distillation column D is preferably by gravity. The leaching fluid in distillation column D is heated in a still 14 through the introduction of heat, shown as coils 16 preferably electric, but steam or one of the well known heating fluids may be an alternative, to a temperature sufficient to boil the leaching fluid from the PCB's. This temperature will, of course, vary with the selection of leaching fluid but preferably, in the case when using perchloroethylene as the leaching fluid, the temperature will be from about 120° C. to about 180° C., and more preferably from about 120° C. to about 150° C., to produce an overhead stream 18 which is leaching fluid substantially free of polychlorinated biphenyls, usually less than about 2 ppm by weight PCB's in later stages of operation, with such PCB's being contained form in a bottoms stream 15 collected in the still 14.

As an example of temperatures which may exist in the still 14 if an askarel containing mixed PCB's in about 40% TCB solvent is used, when the mixture of askarel to perchloroethylene leaching fluid is 50/50, the temperature will be about 135° C.; at 90/10, about 190° C. In contrast a pure PCB (no TCB solvent) mixed with leaching fluid would require temperatures of about 140° C. and 210° C., respectively. In the discussion herein it will be understood that when PCB containing streams are mentioned that a solvent such as TCB may or may not be included.

In the early stages of cleaning and reclassification of electrical apparatus using the instant invention, the overhead stream 18 can tolerate a higher concentration of PCB's and still be considered to be substantially free of PCB's while the foregoing limitation of less than about 2 ppm is more important at later stages of cleaning prior to reclassification tests. The actual concentration of PCB in overhead stream 18 depends upon concentration of PCB's in bottoms 15, number of stages or trays in column D and the temperature of operation. Further concentration of PCB's can be accomplished as described later.

The overhead stream 18 is shown exiting the distillation column D through line 18 as a vapor and proceeding to a condenser C where the vapor is condensed into a liquid through heat exchange, preferably in a finned heat exchanger exposed to atmospheric air for reducing the temperature of the overhead stream 18. In preferred operation line 18 may be packed with a wire mesh such that some ocndensate is formed which falls back into column D as a limited, but uncontrolled reflux. The overhead stream distillate exits the condenser C through line 20 and valve 22 proceeding through line 24 for return through valve 26 and nozzle 28 to the transformer T. The PCB's collect as bottoms stream 15 in the still 14. Heat is applied through coil 16 in the bottoms 15 which contain a portion of the leaching fluid, normally from 50% to about 75% by weight, preferably 80% to 90% leaching fluid toward the end of the reclassification process of this invention.

It will be understood by those skilled in the art that the concentration of the leaching fluid collected in the still 14 may be decreased by raising the temperature used in the distillation column D and by increasing the number of stages in the column D. Typically, in early stages of cleaning, the concentration of leaching fluid, when perchloroethylene, will be maintained at about 50% to about 75% by weight of the bottoms 15 retained in the still 14 of distillation column D in order to avoid providing a distillation column D with more than a single stage which is preferred for simplicity of construction and operation. During later stages before completion of cleaning for reclassification, the leaching fluid concentration in bottoms 15 will preferably be at least about 80% by weight, preferably about 90% and most preferably, about 95% by weight.

The level of such bottoms stream 15 will be monitored by a level controller 30 serving to operate automatic valve 32 in line 34 through which the bottoms stream 15 can be drained to maintain the level within the limits set by level controller 30. The bottoms stream 15 containing PCB's are removed periodically from the column D to purge PCB's from the system and pass through line 34, valve 32 and line 36 to storage for further disposal or further processing. The controller 30 can trigger heat through coil 16 to raise temperature of the still 14 and reduce the volume of the bottoms 15 by increased distillation or to operate valve 6 to regulate flow of leaching fluid to distillation column D.

The distillation column D is designed preferably, as mentioned above, to have but a single stage distillation zone for the sake of simplicity of construction and operation as well as simplicity of design for starting, stopping, and restarting the apparatus. The number of distillation staages required may be varied considerably dependent upon the leaching fluid chosen, the degree to which the PCB's are to be separated from the leaching fluid in a single pass and the maximum concentration of PCB's to be permitted in the bottoms stream 15 of the distillation column D. In the practice of this invention, it is preferred that the distillation be sufficiently complete to have a PCB concentration of less than about 100ppm early and later, two parts per million by weight in the overhead stream 18. The higher the concentration of leaching fluid in the bottoms 15, the fewer distillation stages required to achieve a substantially clean fluid for recycle to the transformer T. The parameters stated above require only one stage for distillation when the leaching fluid is perchloroethylene, its concentration in the bottoms 15 is from about 50% to about 75% by weight during the early stages of cleaning, and when in the later stages of cleaning the concentration of the leaching fluid is preferably from about 80% to about 95% by weight.

In this preferred embodiment of the invention, only a single stage distillation zone is employed, thereby avoiding the complexities of multistage distillation, including reflux drums, controllers, temperature sensors, and flow valves. To keep PCB concentrations of bottoms 15 in the desired range, periodic manual draining of bottoms from still 14 may be necessary. The leaching fluid can be recovered in an especially preferred second bottoms still from which leaching fluid is recovered and returned to still 14.

To compensate for the removal of PCB's and leaching fluid from the still 14, leaching fluid make-up is added, for example, through line 40, valve 42 and line 44 into line 24 and thus to the transformer T through valve 26 and nozzle 28 to maintain the level of the leaching fluid F in the transformer T at a level above the coil windings W so that while the leaching and PCB removal steps are occurring, the transformer can be maintained in an energized, on-line state performing its function. Other means of addition may be used, including initial changing of enough extra fluid at the initial filling of the transformer to allow for the quantities to be removed during cleaning through discharge from the still 14.

The rate at which the leaching fluid is recycled to the transformer is preferably chosen to insure that during most of the time required for the cleaning of a transformer, PCB's are being removed from the fluid more rapidly than they are being leached from the transformer core into the fluid. Additional make-up fluid is at least added in amounts to assure that the leaching fluid in the transformer always covers the core of the transformer in order that it may be maintained in an energized state during the practice of the method of this invention. In order to maintain a capability for the on-line status of the transformer, the leaching fluid must serve as the coolant/dielectric fluid and cover the core of the transformer being cleaned and reclassified. Otherwise the output of the transformer would be unavailable. The rate of recycle must be substantially equal to the rate at which the contaminated fluid is withdrawn. This can be controlled by a level controller which would serve to operate either the valve 6 for withdrawing leaching fluid from the transformer or the valve 42 for introducing make-up leaching fluid into the system. A preferred means for assuring that the core remains covered, independently of the rate of withdrawal of leaching fluid, is a siphon loop through which the leaching fluid is withdrawn from the transformer which will be described in greater detail later.

The great value of having the capability to clean and reclassify the transformer in an energized state is apparent since the transformer represents an important piece of equipment in the overall operation of many facilities whether it be a city or an industrial plant. It can be extremely awkward and costly to take a transformer out of service for any significant length of time. Since months are usually necessary for cleaning sufficient for reclassification the apparatus must be simple enough to operate unattended and reliable enough to operate continuously without breakdown. The preferred single stage distillation of this invention are simple and reliable.

Figure 4:
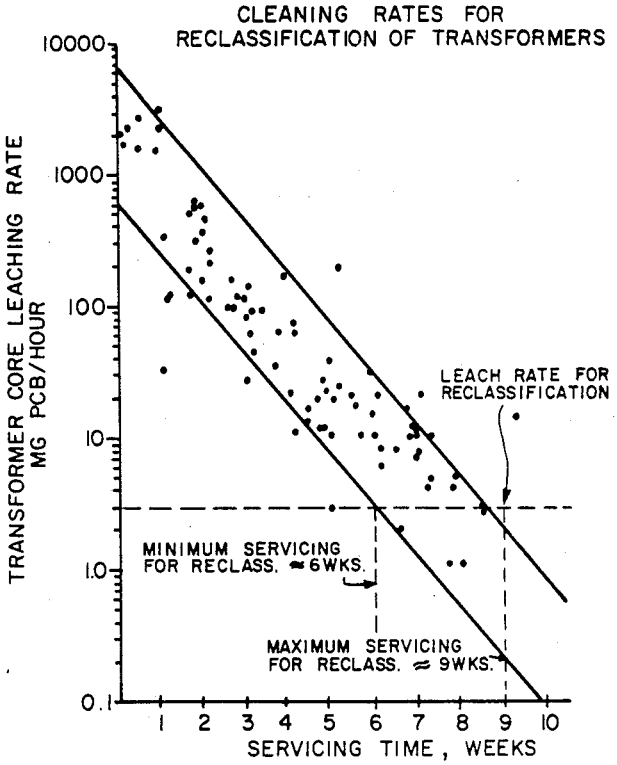
FIG. 4 shows the leaching rate of removing the residual PCB's from the core material during cleaning of transformer prior to the reclassification of transformers (Example 1).

The steps of the method described above are repeated, continuously or periodically, until samples of leaching fluid drawn and analyzed, using known methods indicate that the PCB levels are sufficiently low to draw the conclusion that transformer dielectric fluid used to replace the leaching fluid will remain with a PCB content less than 50 ppm for an operating period of at least 90 days in the complete absence of any fluids processing. Though leaching rates vary widely from transformer to transformer, this conclusion is based upon empirically determined leaching rates as shown in FIG. 4 for transformers treated in Example 1 following. The process can then be stopped and, if desired, leaching fluid discharged through valve 56 or bottoms valve 32 and an alternative transformer fluid introduced through line 40 and the succeeding elements into the transformer T to replace the leaching fluid F. Normally, if a changeout is desired, the substitution will require that the transformer T be taken off line while the leaching fluid is drained and the transformer T is filled. It is possible, though risky, to make the substitution of fluids while the transformer is energized. Of course, valve 22 would be closed and valve 50 would be opened to allow the condensed leaching fluid in line 20 to be removed through line 52, valve 50 and line 54 for collection and further use at a later time. As an alternative, line 54 could join into line 10 allowing the column D to remain operable during the substitution. Should a small period of shutdown be tolerated to replace the leaching fluid F with a permanent fluid, valve 56 (or valve 32) would be opened to allow the drainage of leaching fluid F through nozzle 2, valve 6 and line 8 to divert the fluid through line 58, valve 56, and line 66 into an appropriate collecting vessel (not shown). During this draining or shortly thereafter, the alternative dielectric fluid can be introduced as described above. Once the transition to the alternative fluid is complete, then the transformer T can again be energized by closing valves 26 and 6. The apparatus of this invention can then be disconnected from the transformer T for movement to practice the process of this invention at another time and another place.

In the event that the relative elevations of the transformers and distillation equipment may cause a siphoning of the leaching fluid F from the transformer T during energized state, a siphon breaker means may be installed at nozzle 68 and valve 70 connected to a siphon loop in line 10 as appropriate.

Figure 2:
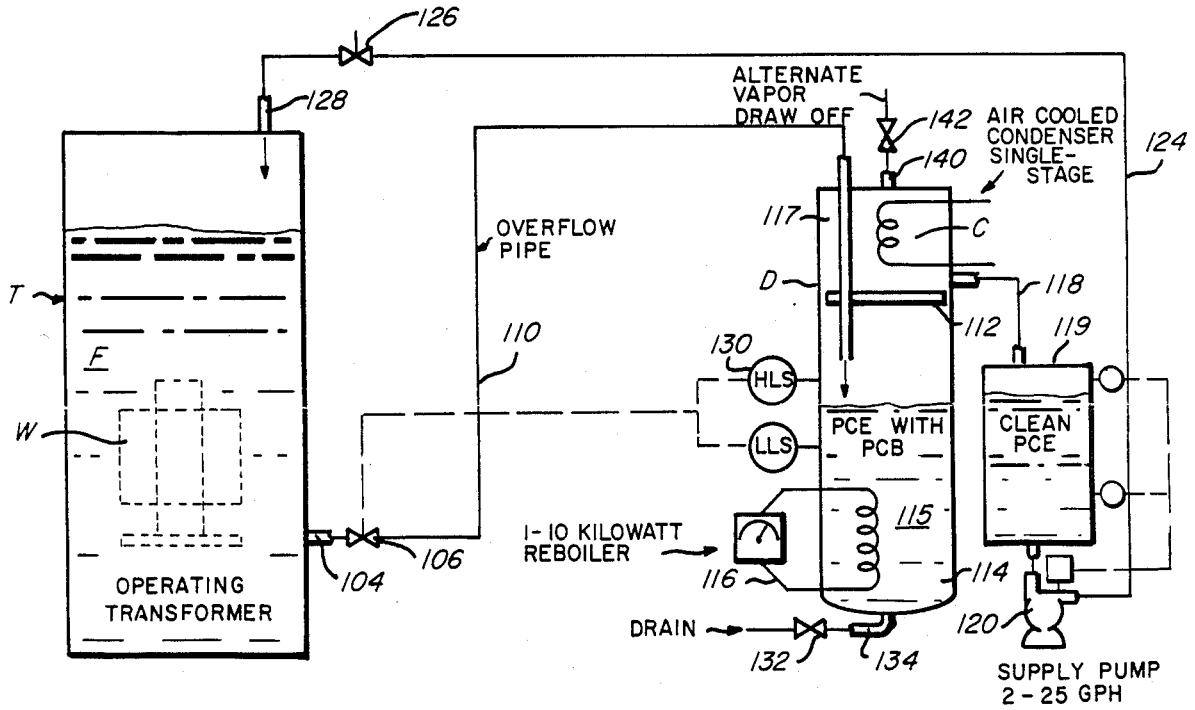
FIG. 2 is a schematic flow sheet of a preferred embodiment of the method of this invention employing a single stage distillation column.

As a preferred embodiment of the practice of this invention, after initial draining and cleaning, a transformer is connected to a single stage distillation unit substantially as schematically shown in FIG. 2. The transformer T with the core W and preferably a perchloroethylene containing leaching fluid is placed on line. The leaching fluid is withdrawn from transformer T through line 104, valve 106 and thence to line 110 through which it is introduced into the distillation column D having a single stage 112 with a still 114 to retain bottoms 115 containing perchloroethylene and PCB's configured to be heated by an electric coil 116 which may be, though not preferable, connected to level control sensors 130 by which the level of the bottoms 115 in the still 114 may be controlled by increasing or decreasing the temperature of the bottoms 115 through the heating coils 116. Such control is preferably set manually and held substantially constant. The higher temperature, of course, would cause the distillation of larger amounts of perchloroethylene and thus lower the level of the bottoms 115 and increase the concentration of PCB's. Preferably, level control sensors 130 can be connected to the solenoid valve 106 to admit more leaching fluid when called for. Reboiler heater 116 causes a vapor stream to form in the distillation column D which passes plate 112 where it enters a cooling zone, or condensing means, 117 cooled by the water or air cooled condenser C. The condensate stream collects on tray 112 and is withdrawn as a liquid from the distillation column D through line 118, which is preferrably packed witha wire mesh, where it is thence stored in a polychloroethylene storage and make-up tank 119 before proceeding through pump 120 into line 124 through valve 126 and line 128 back to transformer T. The distillation column D is also fitted with a drain 134 having a valve 132 for removal of PCB bottoms 115 for further processing or disposal. Also included is an overhead vapor line 140 equipped with a valve 142 in order to provide an optional separate removal for the vapors created during the operation of this experiment.

Figure 6:
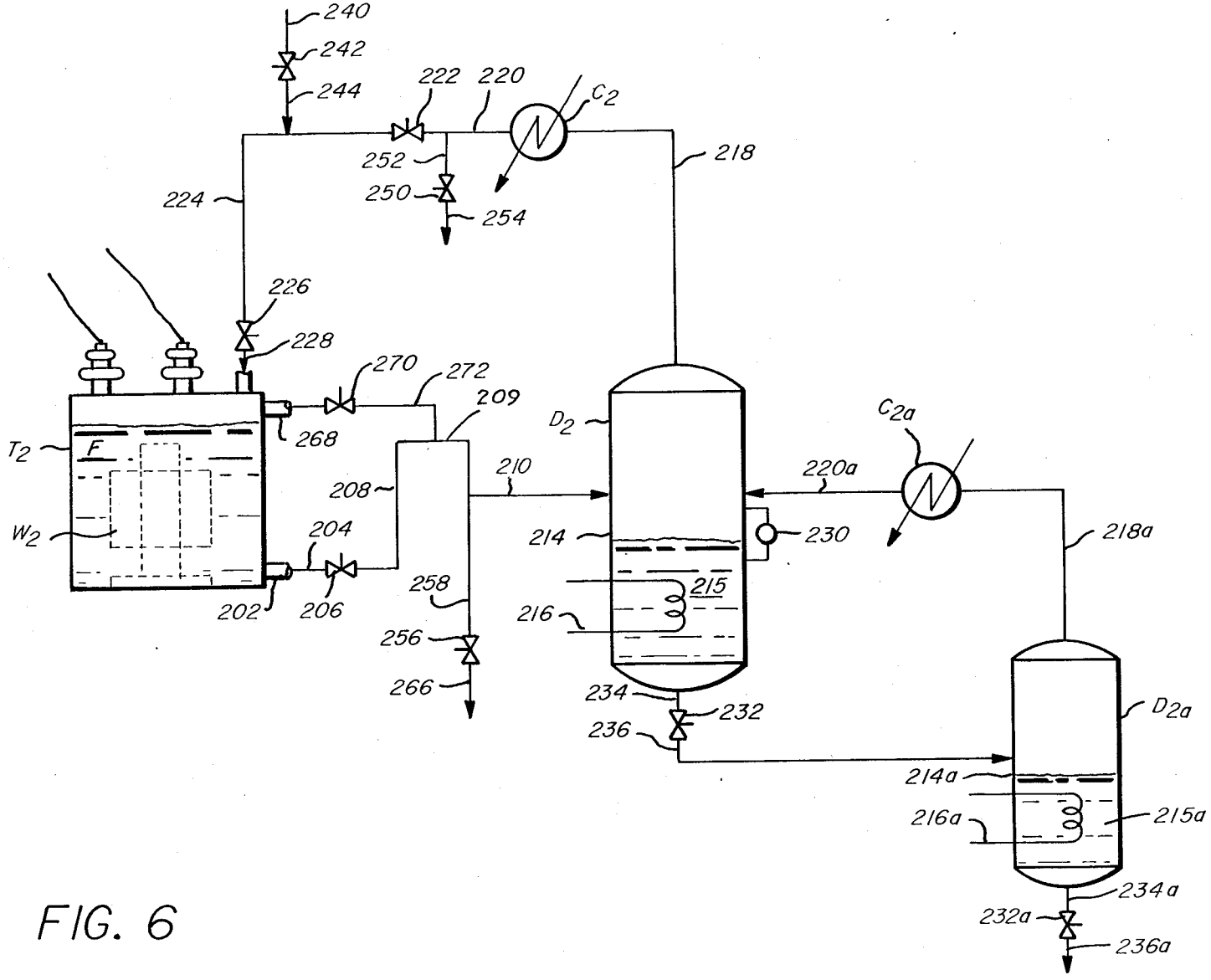
FIG. 6 is a schematic flow sheet of another preferred embodiment of the method of this invention employing dual, single stage distillation columns.

Referring to FIG. 6, as an especially preferred embodiment of the practice of this invention, after initial draining and cleaning a transformer T2 is connected to a combination of two interconnected single stage distillation columns substantially as schematically shown. The transformer T2 with the core W2 is filled with a leaching fluid F such as perchloroethylene. The leaching fluid F is withdrawn from transformer T2 through nozzle 202 at or near the bottom of transformer T, line 204, valve 206 and loop 208 (the purpose of which is explained below) to line 210 through which it is introduced into a first distillation column D2. Distillation column D2 preferably has a single stage distillation zone in still 214 and is operated at substantially zero reflux except for such concentration as might occur in exit overhead line 218. The leaching fluid F in first distillation column D2 is heated in still 214 through the introduction of heat, shown as coils 216 preferably electric or with steam or one of any other well known heating fluids as an alternative, to a temperature sufficient to boil the leaching fluid from the PCB's. As previously mentioned, when perchloroethylene is used as the leaching fluid, this temperature will be from about 120° C. to about 180° C., more preferably from about 120° C. to about 150° C.

The overhead stream produced from first distillation column D2 will preferably be substantially free of PCB's at later stages of transformer cleaning, more preferably about 2 ppm by weight PCB's or less. To accomplish such, the PCB concentration in the bottoms 215 should be kept below about 20% by weight, preferably below about 10% by weight, still more preferably below 5% by weight.

Due to the relatively low temperatures utilized within first distillation column D2, bottoms 215 must be periodically drained or, preferably, discharged to a second distillation column D2*a*, where the bottoms stream is further distilled, usually at a higher temperature (as detailed below), to remove a substantial portion of the remaining leaching fluid from the PCB's. This leaching fluid is then condensed and recycled back to distillation column D2, while the remaining PCB's are initially accumulated within the distillation column D2 and eventually discharged to a second distillation column D2*a*.

The level of bottoms 215 will be monitored by a level controller 230. Level controller 230 may optionally actuate valve 206 to change the rate of flow from transformer T2 or heat coil 216 to raise the temperature of still 214 and reduce the volume of bottoms 215 by increased distillation until the PCB concentration in the bottom of D2 reaches about 20%, preferably about 10% or less, and more preferably about 5% or less. It is preferable to actuate valve 206 for the circulation of additional fluid from the transformer T2 to the first distillation unit D2. Other schemes for accomplishing basic control fo D2 will be appreciated by one skilled in the art.

Periodically, bottoms 215 are preferably drained through line 234, valve and line 236 into a second distillation column D2*a*. Distillation column D2*a*, like distillation column D2, preferably has a single stage distillation zone and is operated as set forth above. The bottoms 215 in distillation column D2*a* is heated in a still **214*a* through the introduction of heat, shown as coils 216*a*** preferably electric or with steam or one of any other well known heating fluids as an alternative, to a temperature sufficient to boil a substantial amount of the leaching fluid from the PCB's. When perchloroethylene is used as the leaching fluid, this temperature will be from about 120° C. to about 210° C., more preferably from about 150° C. to about 180° C. While the overhead of second distillation column D2*a* does not carry a specific PCB concentration restriction, it should for successful operation remain less than the concentration in the still 214. The leaching fluid is vaporized from the bottoms stream **215*a* to produce a PCB concentration of from about 70% to about 95%, more preferably from about 80% to about 95%, in the bottoms 215*a***. Such concentrations reduces the volume of waste for ultimate disposal to about one forth to one tenth of what it would be with only a single stage.

The level of bottoms **215*a* will be monitored and controlled by a controller (not shown) operating heater 216*a* or valve 232*a*. The bottoms 215*a*** rich in PCB's may be either accumulated throughout the cleaning period or removed periodically to purge the PCB's from distillation column D2*a* through line **234*a*, valve 232*a* and line 236*a*** to storage and/or further disposal.

In one embodiment of D2*a* operation, bottoms from D2 are fed to D2*a* through valve 232 and line 236 until the controller **230*a*** signals that D2*a* is full through its high level switches (HLS). Valve 232 is then closed and heat is applied to D2*a* to boil leaching fluid away from PCB's. This proceeds until the level of liquid in the bottom of second column D2*a* falls enough to trigger the low level switch (LLS). At this point, the controller optionally can open valve 232 to receive more fluid from first column D2 or temporarily turn off the heat source to second column D2*a*. Thus, the majority of the PCB's in the bottom of first column D2 is transferred to second column D2*a*. If the quantity of PCB's to be accumulated in second column D2*a* exceeds the capacity of the unit part of the contents of second column D2*a* can be discharged to a separate storage tank. Second distillation zone D2*a* can be designed to accommodate up to about 50% PCB's and chlorinated benzenes (i.e., TCB solvent) preferably up to about 80% PCB's and chlorinated benzenes, and more preferably up to about 90% PCB's and chlorinated benzenes.

The overhead stream produced by distillation column D2*a* exits through line **218*a*** as a vapor and proceeds to a condensing means C2*a*, where the vapor is condensed into liquid through heat exchange, preferably in a finned heat exchanger exposed to atmospheric air for reducing the temperature of the overhead stream. The condensate exits condenser C2*a* through line **220*a* and is recycled into the bottom of distillation column D2 wherein it commingles with bottoms 215 and fluid entering from line 210** for further treatment therein.

The overhead stream produced by distillation column D2 exits through line 218 as a vapor and proceeds to a condenser C2, where the vapor is condensed into liquid through heat exchange, preferably in a finned heat exchanger exposed to atmospheric air for reducing the temperature of the overhead stream. The condensate exits condenser C2 through line 220 and valve 222 and proceeds through line 224 for return through valve 226 and nozzle 228 to the transformer T2.

To compensate for any removal of leaching fluid from still 214*a*, leaching fluid make-up may be added, for example, through line 240, valve 242 and line 244 into line 224 and thus to transformer T2 as previously described. Very little leaching fluid will be removed from still 214*a*, however, due to the high PCB concentration and low volume of bottoms 215*a*. Leaching fluid can additionally be removed, if desired, from line 220 through line 252, valve 250 and line 254. When draining transformer T2 for the replacement of the leaching fluid with a permanent fluid, the leaching fluid can be drained from line 210 through line 258, valve 256 and line 266.

As previously indicated, it is imperative during the cleaning process that the level of leaching fluid within transformer T2 remain above core W2. As depicted in FIG. 6, a loop 208 is preferably installed between line 204 and 210, and a siphon breaker 272 is installed above fluid level at nozzle 268 and valve 270 (optional) in loop 208 which operators to open if fluid F drops below the limits of level controller 273.

Loop 208 is an arched section between lines 204 and 210, with the apex 209 of the arch being higher in elevation than the top of core W2 and below the surface of fluid F normally present in transformer T2. The entrance of line 210 into first distillation zone D2 is usually below the level of fluid F in transformer T2 to provide gravity feed. When leaching fluid level drops in transformer T2 exposing the apex 209 of loop 208 to a liquid free void in transformer T2 a potential siphon is broken. This stops the draining of transformer T2 and protects the core W2. When the level of fluid in transformer T2 exceeds the level of the apex 209 the flow of fluid F again starts to the first distillation unit D2. Since transformers often have sediment which invades the leaching fluid F the siphon breaker is a protection against the consequences of valve 206 becoming stuck in the open position.

The second specific embodiment as depicted in FIG. 6 and discussed above provides several operational advantages. The dual distillation zones provide the effectiveness of multistage distillation with the process complications attendant to such. The apparatus of FIG. 6 requires no more than on/off process control, whereas a multistage unit would require substantially more and complex proportional or proportional/integral controls, as well as additional equipment in the form of reflux tanks, reflux pumps, flow monitors and controls. Many situations can arise during the operation of this equipment which would require an automatic pause or temporary shutdown of the equipment. Due to the simplified process control of the system of the preferred embodiment, these interruptions in service are easily handled by the on/off nature of the process control. Achievement of such control with a multistage unit is, as is well known by one skilled in the art, at best costly and complicated.

EXAMPLE 1

As an example of the operation of this above described invention, three 50-KVA transformers were drained of Askarel, a PCB containing dielectric fluid. To determine whether the intermediate treatment affects the final result, one transformer was treated by condensing perchloroethylene vapors on the core and walls with removal of the condensate to remove residual bulk Askarel. The internals of the second transformer were sprayed with perchloroethylene leaching fluid (vapor) which were condensed and drained. The third was cleaned of the bulk residual Askarel by simple liquid flushing with perchloroethylene.

Figure 3:
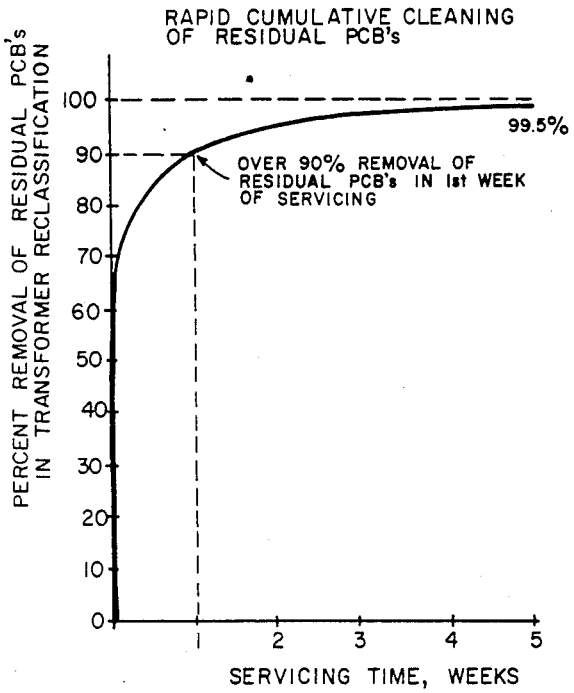
FIG. 3 shows the rate of removal of residual PCB's from transformers in the practice of the invention of this application (Example 1).

Distillation equipment similar to that described in FIG. 2 was used in the conduct of these examples through not directly piped to the transformer itself for continuous operations. During the experiments all three transformers were filled with perchloroethylene and energized for varying periods of time, then shut down and drained. At the beginning the shut-downs were more frequennt than later. The leaching fluid was analyzed to determine the PCB content and distilled to separate perchloroethylene as an overhead stream and collect PCB's mixed with perchloroethylene as the bottoms. The overhead stream was collected and returned to the transformer which was energized again. Care was taken to maintain the core in a submerged condition and free from contact with oxygen or moisture while in operation. The method of this invention was continued in its intermittent manner until it was determined that leaching rates for residual PCB's in the transformer was sufficiently low to permit reclassification. This required approximately five weeks of operation and the resulting curve of the cleaning the test transformers is shown in FIG. 3.

The results of analysis of samples taken of leaching fluid removed from the three transformers during operations were used to determine leaching rates of PCB's from the core of the three transformers. FIG. 4 is a plot of such leaching rate as determined upon the analysis of the leaching fluid and the length of time such fluid remained in the energized transformer. Even though the amount of time required to clean individual transformers may vary widely, points plotted for other transformers as on FIG. 4 for the test transformers can be used to determine the minimum and maximum servicing times for a particular piece of equipment. The leaching fluid may optimally be replaced with a permanent dielectric fluid and the reclassification test, as shown on FIG. 5 for one of the transformers reclassified in this experiment, performed. Accordingly from the foregoing it can be seen that the intermittent practice of the steps of this invention accomplish the result of reclassification as well as the continuous operaiton hereinbefore described.

Figure 5:
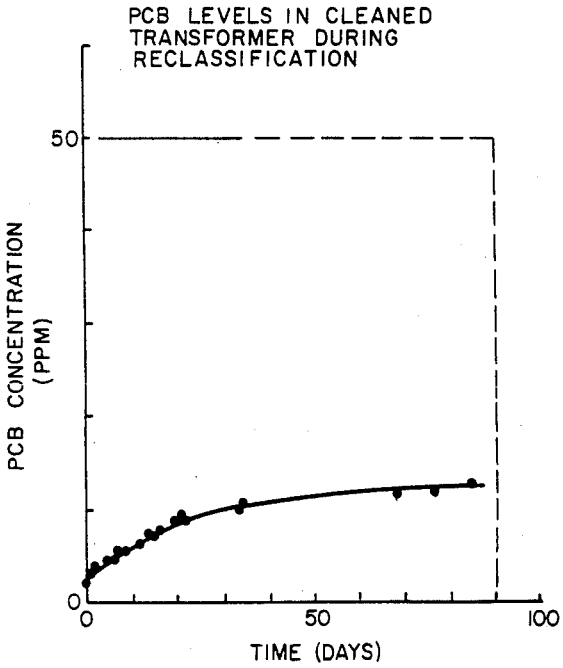
FIG. 5 shows the PCB levels in transformer dielectric fluid for three months monitoring for reclassification after the cleaning process of the instant invention has been completed (Example 1).

The operation described above was continued for six to nine weeks with the transformers energized to reduce the PCB leaching rate to a level acceptable for reclassification. FIG. 3 is a composite of the data of all three tests run showing the approximate rate of removal of the residual PCB's from the transformers. FIG. 4 is a plot of the combined data obtained from the practice of the method for the cleaning to the point of reclassification of each transformer showing the leaching rate of the PCB from the core as a function of energized transformer cleaning time. FIG. 5 shows the PCB concentration of one transformer during the 90 day reclassification after practice of the method to be well within the 50 ppm now allowed by the EPA for reclassification of the transformers. Even lower levels may be obtained as shown in FIG. 5 should EPA regulations become even more restrictive.

EXAMPLE 2

Table 1 shows results comparing a single stage processor (FIG. 1 or 2) without a second distillation zone and a first single stage distillation zone combined with a second bottom distillation zone as depicted in FIG. 6. The combination includes the ability to concentrate PCB's in second bottoms D2*a*, stream, control PCB concentration in column D2 at desired range and ability to control PCB accumulation at less thand 2 ppm in the holding tank for recycle to the first distillation zone.

To simulate a contaminated transformer, a vessel was filled with perchloroethylene based leaching fluid.

Into this simulated transformer, an askarel containing 50% trichlorobenzene and 50% mixed PCB's, was added in the amounts shown and at the times indicated in Table 1. The apparatus of this stage distillation unit (D2) and later as a combination of two single stage distillation units (D2 and D2*a* ).

The first distillation unit D2 was configured to draw fluid from the simulated transformer periodically as fluid boiled, thereby lowering the liquid level in the still 214. The temperature in the still 214 varied with the concentration of PCB's, ranging from about 121° C. (minimal PCB content) to about 135° to 140° C. (40% to 50% PCB's). Condensed leaching fluid was accumulated in holding tank 119 (see FIG. 2) and recirculated to the transformer. As shown in Table 1, over a period of 10 days, regular increments of askarel were added to D2. Due to the boiling and clean recycle action of D2, the level of PCB's in the still 214 rose rapidly, leveling out when additions of askarel to the transformer were stopped and rising again when additions of askarels resumed.

On day 38, the second single stage distillation unit D2*a* was connected to first distillation unit D2 and portions of the contents of the first still 214 were periodically fed to second distillation zone D2*a* where they varied with the concentration of PCB's, ranging from about 125° C. (about 10% PCB's) to about 190° to 210° C. (about 90% PCB's). PCB's were accumulated in second distillation zone D2*a* and boiled fluids were recycled to the boiling chamber of first distillation zone D2. As shown in Table 1, immediately following the startup of second distillation zone D2*a*, the PCB concentration of the boiling chamber in D2 begins to fall while PCB concentration of the still 214*a* begins to rise. The decline in PCB concentration in the still 214 occurs despite the steady addition of PCB's to the transformer. As the concentration of PCB's in the still 214 falls, the residual PCB content of condensed fluid in the holding tank 119 rapidly falls to less than 2 ppm and remains there. At the same time, the concentration of PCB's in the still 214*a* rises rapidly. At steady state, with no addition of PCB's to the transformer, the concentration of PCB's in the first distillation zone D2 falls to about 0.1% and all of the PCB's collect in the still 214*a*.

TABLE 1

PERFORMANCE OF PROCESSOR ALONE AND WITH SECOND DISTILLATION ZONE

| Cumulative Askarel to Transformer PCB mls | Contents of Processor: PCB in Distillation Zone One 215 mg/l | PCB in Hold Tank* 119 mg/l | PCB in Distillation Zone Two 215a mg/l | Test Day No. |
|---|---|---|---|---|
| A. Operation of Processor Only | | | | |
| 0 | <2 | <2 | 0 | 0 |

TABLE 1-continued

PERFORMANCE OF PROCESSOR ALONE AND WITH SECOND DISTILLATION ZONE

| Cumulative Askarel to Transformer PCB mls | Contents of Processor: PCB in Distillation Zone One 215 mg/l | PCB in Hold Tank* 119 mg/l | PCB in Distillation Zone Two 215a mg/l | Test Day No. |
|---|---|---|---|---|
| 1,800 | 43,010 | <2 | 0 | 1 |
| 3,000 | 74,547 | 4 | 0 | 2 |
| 4,500 | 117,072 | 3 | 0 | 2 |
| 6,000 | 142,731 | 5 | 0 | 7 |
| 7,800 | 205,684 | 7 | 0 | 8 |
| 9,400 | 251,715 | 6 | 0 | 8 |
| 9,400 | 249,164 | 8 | 0 | 9 |
| 9,400 | 251,104 | 7 | 0 | 9 |
| 9,400 | 235,675 | 9 | 0 | 10 |
| 9,400 | 235,514 | 9 | 0 | 10 |
| 11,000 | 273,162 | 7 | 0 | 11 |
| 11,000 | 282,358 | 11 | 0 | 11 |
| 11,000 | 271,725 | 8 | 0 | 11 |
| 12,500 | 308,228 | 10 | 0 | 14 |
| 14,100 | 411,971 | 13 | 0 | 16 |
| B. Processor Plus Bottoms Processor | | | | |
| 19,500 | 10,857 | <2 | 422,433 | 38 |
| 20,500 | 12,708 | <2 | 482,746 | 39 |
| 21,500 | 1,231 | <2 | 519,531 | 45 |
| 23,100 | 13,784 | <2 | 536,480 | 47 |
| 25,100 | 17,538 | <2 | 600,081 | 52 |
| 26,100 | 26,694 | <2 | 655,546 | 52 |

*Shown in FIG. 2

The foregoing invention having been described as set forth above, could be practiced by those skilled in the art using many obvious and easily understood modifications based on the foregoing description. Any such modifications are considered to be within the scope of the invention herein described and hereafter claimed.

I claim:

1. Apparatus for cleaning for reclassification an electrical apparatus containing contaminants with polychlorinated biphenyls which comprises:

(a) means for removing and conducting a leaching fluid contaminated with polychlorinated biphenyls from said electrical apparatus;

(b) a first single-stage distillation column to receive said contaminated fluid configured to form an overhead vapor stream consisting essentially of the leaching fluid and a bottoms stream contaminated with polychlorinated biphenyls;

(c) condensing means for condensing the vapor in said vapor stream consisting essentially of the leaching fluid from said first single-stage distillation column;

(d) means for returning the condensed leaching fluid to the electrical apparatus;

(e) means for withdrawing and conducting the bottoms stream from said first single-stage distillation column;

(f) a second single-stage distillation column to receive the bottoms stream configured to form an overhead vapor stream consisting essentially of the leaching fluid and a bottoms stream containing polychlorinated biphenyls;

(g) condensing means for condensing the vapor in said vapor stream from said second single-stage distillation column; and (h) means for conducting the condensed leaching fluid condensed from said second single-stage distillation column to the first-stage distillation column.

2. The apparatus of claim 1 where the electrical apparatus is a transformer.

3. The apparatus of claim 1 which includes in the means for conducting leaching fluid from the electrical apparatus a loop including a siphon breaker means between the electrical apparatus and the first single stage distillation column.

4. The apparatus of claim 1 wherein the condenser is an atmospheric condenser.

5. Apparatus for cleaning fluid contaminated with polychlorinated biphenyls which comprises:

(a) means for removing fluid from a contaminated apparatus which is being decontaminated;

(b) first single-stage distillation means to receive said contaminated fluid configured to form an overhead vapor stream consisting essentially of said decontaminated fluid and a bottoms stream contaminated with polychlorinated biphenyls;

(c) condensing means for condensing vapor in said overhead vapor stream;

(d) means for returning condensed decontaminated fluid to said apparatus which is being decontaminated;

(e) means for withdrawing said bottoms stream from said first single-stage distillation means; and (f) second single-stage distillation means to receive said bottoms stream configured to form an overhead vapor stream consisting essentially of said decontaminated fluid and a bottoms stream containing polychlorinated biphenyls.

6. Apparatus according to claim 5 which further includes:

condensing means for condensing vapor in said overhead stream from said second single-stage distillation means; and means for conducting the condensed leaching fluid from said second single-stage distillation means to the first-stage distillation means.

7. Apparatus according to claim 5 which further includes:

valve means in said means for withdrawing said bottoms stream from said first single-stage distillation means.

* * * * *